US007514620B2

(12) United States Patent
Friedman et al.

(10) Patent No.: US 7,514,620 B2
(45) Date of Patent: Apr. 7, 2009

(54) METHOD FOR SHIFTING PITCHES OF AUDIO SIGNALS TO A DESIRED PITCH RELATIONSHIP

(75) Inventors: Sol Friedman, Beverly Hills, CA (US); Josephine Friedman, legal representative, Thousand Oaks, CA (US); Hanns-Christof Adam, Norderstedt (DE); Steffan Diedrichsen, Schleswig-Holstein (DE)

(73) Assignee: Apple Inc., Cupertino, CA (US)

( * ) Notice: Subject to any disclaimer, the term of this patent is extended or adjusted under 35 U.S.C. 154(b) by 222 days.

(21) Appl. No.: 11/510,031

(22) Filed: Aug. 25, 2006

(65) Prior Publication Data

US 2008/0047414 A1 Feb. 28, 2008

(51) Int. Cl.
*G10H 1/44* (2006.01)

(52) U.S. Cl. ..... 84/454; 84/600

(58) Field of Classification Search ..... 84/600–602, 84/454

See application file for complete search history.

(56) References Cited

U.S. PATENT DOCUMENTS 4,152,964 A * 5/1979 Waage ..... 84/675
4,248,119 A * 2/1981 Yamada ..... 84/637
5,442,129 A * 8/1995 Mohrlok et al. ..... 84/637
5,501,130 A * 3/1996 Gannon et al. ..... 84/454
5,973,252 A * 10/1999 Hildebrand ..... 84/603
6,448,487 B1 * 9/2002 Smith ..... 84/669
6,777,607 B2 * 8/2004 Smith ..... 84/669
6,924,426 B2 * 8/2005 Clynes ..... 84/609
6,995,311 B2 * 2/2006 Stevenson ..... 84/737

OTHER PUBLICATIONS

Antares, Auto-Tune 4, TDM Production Suite, Antares Audio Technologies-2007, located on the internet at http://www.antarestech.com/products/atsuite.shtml, retrieved on Jan. 30, 2007, 2 pages.
Celemony, "Vocal editing—Good, better, optimum," Celemony Software GmbH—2007, located on the internet at http://www/celemony.com/cms/index.php?=melodyne_vocaledit0, retrieved on Jan. 30, 2007, 2 pages.
Celemony, "Melodyne," Celemony Software GmbH, located on the internet at http://www.celemony.com/melodyne/Details.html, retrieved on Jan. 30, 2007, 4 pages.

* cited by examiner

*Primary Examiner*—David S. Warren
(74) *Attorney, Agent, or Firm*—Hickman Palermo Truong & Becker LLP

(57) ABSTRACT

A method and apparatus for shifting pitches of audio signals to achieve desired pitch relationships between the audio signals. Two or more audio signals are received. The audio signals may be in either a digital or analog format. One of the input audio signals is selected to be a reference signal. For each of the other audio signals, the pitch of the other audio signal is compared with the pitch of the reference signal to determine a relative pitch relationship. For each of the other signals, an adjustment is determined to bring the relationship to a desired pitch relationship. Based on the adjustment, the pitch of at least one of the audio signals is adjusted to achieve the desired pitch relationship between the audio signals.

27 Claims, 4 Drawing Sheets

METHOD FOR SHIFTING PITCHES OF AUDIO SIGNALS TO A DESIRED PITCH RELATIONSHIP

FIELD OF THE INVENTION

The invention relates to the field of audio signal processing, and more specifically to improving pitch relationships in musical audio.

BACKGROUND

Much effort has been focused on developing means for processing audio signals to advance the listening experience. For example, electronic mixers are used to mix or blend together separate musical tracks or sequences to create a single performance. Other mechanisms have focused on enhancing the characteristics of a single musical track, e.g., by boosting certain desired frequencies and attenuating others through electronic equalization.

Some efforts have been made to adjust the tuning of electronic instruments. Proper tuning can mean the difference between a full, rich, resonating sound and a flat, lack-luster sound. Yet, due to physical constraints on instruments and the varying relationships of musical chords, proper tuning is difficult, if not impossible to attain throughout a musical performance. This problem is described in more detail below, with further background on the nature of musical chords.

In particular, there have been some efforts at what may be referred to as "variable tuning," which makes pitch adjustments based on what notes are being played. For example, one type of variable tuning examines the chord being played by one or more instruments and makes pitch adjustments based on the chord. Some efforts at variable tuning have been made based on MIDI data, which some instruments are capable of generating. MIDI is a form of music notation that describes what note should be played and when. A MIDI file is a data stream of note events in a digital format that includes meta-information about each note to be played. This meta-information includes note characteristics such as pitch, attack, envelope, etc. MIDI note events can be generated by an electronic keyboard, for example. To hear the music represented by a MIDI file, the MIDI information is used to drive a tone generator or synthesizer at the specified pitch, with the specified attack and envelope characteristics.

Audio signals from other musical instruments (or vocals) have a substantially different format than MIDI data. For example, a musical instrument (or voice) provides signals that are transformed by a transducer (e.g., a microphone or guitar pick-up) for amplification, transmission and/or recording purposes. These signals typically describe how the amplitude of the input audio signal changes over time. For example, a typical audio signal in digital format is based on samples of the magnitude of the input audio signal, with the sampling rate being at least twice (typically greater) the highest frequency of interest.

As previously discussed, variable tuning may be based on what chord is being played. As used herein, the term "chord" means any combination of two or more notes played simultaneously. The ratio between the pitches of notes in a chord, affects the sound. Chords typically sound best when the instrument is tuned with what is referred to as "harmonic tuning". With harmonic tuning the ratio of the pitch between notes in a scale can be represented by integers that are relatively small. For example, using harmonic tuning, the ratio of the pitch between the lowest note in a given scale and three notes higher (a small third) is precisely 6/5. As another example, the ratio of the pitch between the lowest note in a given scale and four notes higher (a large third) is precisely 5/4. As still another example, the ratio between the lowest note and seven notes higher (a pure fifth) is 3/2.

While harmonic tuning produces very good sounding chords, an instrument that is harmonically tuned can only play in a single key. The reason lies in the fact that the difference in pitch between successive notes in a scale is not uniform when using harmonic tuning. Hundreds of years ago, instruments such as harpsichords were tuned specifically for a single key (e.g., C-major, G-major, etc.). A collection of several harpsichords was therefore required to play different songs having different keys. Moreover, key changes within a song were impractical with harmonic tuning, as that would require a change of instruments.

Equal tempered tuning was invented to equalize the ratio of the pitch between successive notes in a scale. That is, if equal tempered tuning is being used, the pitch of each successive note in a scale is exactly two raised to the one-twelfth power times the pitch of the preceding note. Thus, the ratio of the pitch between A and A-sharp is precisely the same as the ratio between D and D-sharp, or between G-flat and G. Although the equal tempered tuning provides convenience and standardization across the scale, it does so at the expense of pure-sounding chords.

As previously discussed, some efforts have been made at variable tuning. One such effort is described in U.S. Pat. No. 5,442,129, issued to Werner Mohrlok. The Mohrlok patent discloses a chord recognition circuit, which ascertains at each MIDI input signal pattern (i.e., set of concurrent note events) corresponding to a chord, whether the input signal pattern corresponds to a chord pattern from a predetermined set of chord patterns. The chord patterns are stored in a chord table that has an entry for each chord pattern. Each entry has 12 attributes (corresponding to notes such as "A" "A-sharp", etc), with each attribute describing whether that note is present or absent in the chord. When a chord recognition circuit ascertains that a MIDI input signal pattern corresponds to one of the predetermined chord patterns, a control circuit causes a signal pattern store circuit to emit an "optimally-"tuned output signal pattern.

An underlying assumption in the Mohrlok patent is that the input data is based on the same tuning upon which the chord table is based. For example, if the input data is based upon equal tempered tuning, the assumption is that the chord table is also based upon equal tempered tuning. However, if the input data (e.g., MIDI data) does not conform to the same tuning as the chord table, then searching the chord table for a pattern (e.g., chords) that matches the pattern in the input signal will, at best, produce unpredictable results. For typical MIDI data the assumption that the input data is based on the same tuning upon which the chord table is based may be valid. However, for a more general class of input audio data, this assumption may not hold. For example, the input data may conform to a different type of tuning or may not conform to any standard or known form of tuning.

In view of the foregoing, there is a need for a mechanism to provide variable tuning for musical chords embodied in audio signals.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

Figure 1:
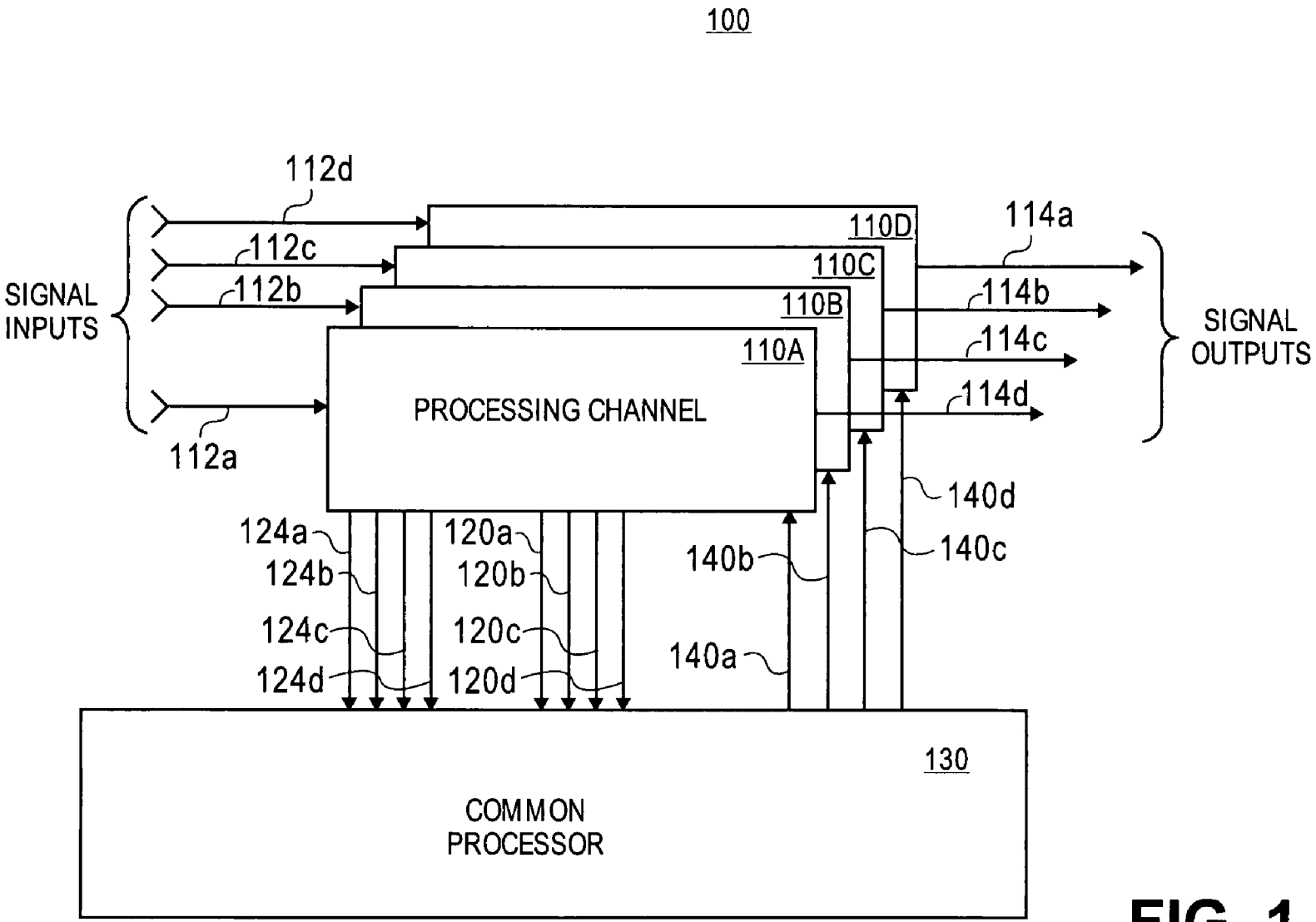
FIG. 1 is a diagram of a system for shifting the pitch one or more an audio signals to achieve a desired pitch relationship, in accordance with an embodiment of the present invention.

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

Overview

A mechanism for enhancing the quality of a musical performance, whether recorded or live, by automatically adjusting the pitch of the individual notes throughout the performance is disclosed herein. Different pitch adjustments are applied as the music progresses and the pitch relationships between the notes currently being played changes. Some illustrative examples of where such a mechanism might be applied include a horn section of an orchestra, a single electrical guitar, or pre-recorded music.

In the horn section example, each horn (e.g., trumpet, trombone, etc.) may be equipped with its own microphone, so that a channel of audio data is produced for each instrument. Each instrument's audio signal may then be processed relative to the audio signals of the other instruments. The processing of the audio signals may include performing a pitch shift appropriate to one or more notes of the chord being played by the instruments as a whole.

For the electrical guitar example, the guitar may be equipped with a hexaphonic pickup, which transmits a channel of audio data for each guitar string. Those six channels are processed to determine and implement appropriate pitch shifts to the audio signal on one or more channels based on the chord being played across multiple strings, in an embodiment of the invention.

A pitch shift is applied to one or more audio signals from pre-recorded audio data to produce a desired pitch relationship between the audio signals, in accordance with an embodiment of the present invention. As an example, a horn section can be recorded into a sequencer, such that each instrument is recorded on a separate channel. A new recording is made with pitch shifts applied to one or more of the channels, based on the notes being played in the various channels at a particular point in time, in an embodiment of the invention.

An embodiment of the present invention is a method comprising the following steps. The steps may be performed in hardware, software, or a combination thereof. Two or more audio signals are received on a corresponding two or more channels. The audio signals may be in either a digital or analog format. An audio signal may comprise a single frequency. However, a particular audio signal may comprise multiple frequencies, in which case one of the frequencies is selected as being characteristic of the audio signal. For example, an input audio signal may have a fundamental frequency and harmonics. The fundamental frequency is selected for processing, in one embodiment. In one embodiment, the audio signals are processed when received to remove unwanted frequency variations. For example, vibrato may be removed prior to processing the audio signals further. One technique to remove vibrato is to filter it out by calculating a moving average of the pitches of a given audio signal.

One of the input audio signals is selected to be a reference signal. In one embodiment, the selection of the reference signal is pitch based. For example, the audio signal having the lowest pitch is selected as the reference signal. In one embodiment, the selection of the reference signal is channel based. For example, the reference signal is always the audio signal from a particular channel. As a particular example, one of the channels might be a vocal, with the other channels being the audio signal of accompanying instruments. The vocal channel can be used as the reference signal regardless of the pitch relationship between the audio signal on the vocal channel and the audio signals on the other channels.

For each audio signal other than the reference signal, the pitch of the other audio signal is compared with the pitch of the reference signal to determine a relative pitch relationship. For each of the other signals, an adjustment is determined to bring the pitch relationship to a desired pitch relationship. In some cases, no adjustment will be needed to achieve the desired pitch relationship. The desired pitch relationship is a desired ratio, in one embodiment. The desired ratio is of the form n/m, wherein n and m are integers selected from a pre-determined set, in one embodiment. The integers n and m are limited to values between 1 and 16, in one embodiment. The desired ratio is based on "just intonation", in one embodiment. For example, the desired ratio is taken from a set that includes ratios between the pitches of two notes in a scale when just intonation, otherwise refereed to as harmonic tuning, is used.

The result of determining the adjustments is a set of adjustments. Based on this set of adjustments, the pitch of at least one of input audio signals is shifted, to bring the pitch relationships between the audio signals to the desired pitch relationship. For example, assume that the audio signal of a trumpet on channel A is selected as the reference signal. Based on an adjustment to bring the pitch relationship of the audio signal of a trombone on channel B to a desired relationship with the trumpet, the pitch of trombone's audio signal shifted. The pitch of the audio signal of a flute on channel C can be shifted in a similar manner. Thus, the pitch of each audio signal is shifted based on its pitch relationship to the trumpet, in this example. Over time, a different instrument can be the reference, or the same instrument can be used as a reference at all times.

In one embodiment, a further pitch shift is determined for each audio signal, including the reference signal, based on the adjustments that were determined to bring the pitch relationships to desired pitch relationships. A reason for applying this further pitch shift is to cause notes in successive chords to sound better. For example, were the pitches of the audio signals shifted based only on the previously discussed adjustment, then successive chords might sound improper to the listener if the pitch shift to a common note was different for the two chords. Thus, chords having at least one note in common might sound improper to the listener. By applying the further pitch shift, the common notes in successive chords sound better.

System Overview

FIG. 1 is a diagram of a system 100 for shifting pitches of audio signals to achieve desired pitch relationships between the audio signals, in accordance with an embodiment of the present invention. Each processing channel 110*a*-110*d* receives an audio signal on an input signal line 112 and outputs a (potentially) pitch shifted audio signal on an output signal line 114. There may be any number of processing channels. The input audio signals are digital signals, in this embodiment. Each input audio signal may be processed by an analog-to-digital (A/D) converter (not depicted in FIG. 1) prior to being input to a processing channel 110.

The source of an input audio signal may be an acoustic instrument such as an acoustic guitar, violin, brass instrument, etc, wherein an acoustic wave from the acoustic instrument is processed by a microphone prior to input to the A/D converter. The source of the audio signal might also be an electric instrument such as an electric guitar, wherein an electrical signal from the guitar's pick-up is passed through an A/D converter prior to being input to the processing channel. As a particular example, the electric guitar may be equipped with a hexaphonic pickup to produce a six signal output. That is, the hexaphonic pickup outputs one electrical signal per guitar string.

The source of the audio signal may also be a digital recording. As an example, a horn section can be recorded into a sequencer, such that each instrument is recorded on a separate track. Thus, one track is input on each input signal line 112*a*-112*d*.

The input audio signal may contain energy at more than one frequency. For example, the audio signal may have a fundamental frequency and harmonics. The fundamental frequency is not necessarily the frequency having the greatest amplitude in the audio signal. Each processing channel 110*a*-110*d* determines a fundamental frequency of the input audio signal and outputs pitch information on one of the pitch signal lines 120*a*-120*d*. The pitch information is a digital value that defines the fundamental frequency, in one embodiment. Each processing channel outputs pitch information at a regular interval in one embodiment. For example, processing channel 110*a* periodically determines the fundamental frequency on the input audio signal on line 112*a* and passes a digital value representing the fundamental frequency to the common processor 130.

Each processing channel 110*a*-110*d* also outputs a valid/invalid signal on one of the valid/invalid signal lines 124*a*-124*d*. The valid/invalid signal indicates whether the audio signal on the pitch line 120*a*-120*d* is valid. As an example, if processing channel 110*a* determines that the input signal on audio signal line 112*a* is non-periodic (e.g., noise) then processing channel 110*a* provides an invalid signal on the valid/invalid line 124*a*. An input audio signal could be invalid for a reason other than being noise. For example, if the fundamental frequency of the input audio signal is out of a range of interest, it is determined to be invalid in accordance with one embodiment.

The common processor 130 determines a pitch shift for one or more of the input audio signals, depending upon the pitch relationships between the various input audio signals. The common processor 130 outputs a pitch shift value on each of the pitch shift lines 140*a*-140*d*. The pitch shift value on a particular line 140*a*-140*d* can be a null indicator if no pitch shift is desired.

Each processing channel 110*a*-110*d* inputs one of the pitch shift values and shifts the pitch of its input audio signal based thereupon. Each processing channel 110*a*-110*d* outputs an audio signal, which has its pitch shifted in accordance with the pitch shift value.

Channel Overview

Figure 2:
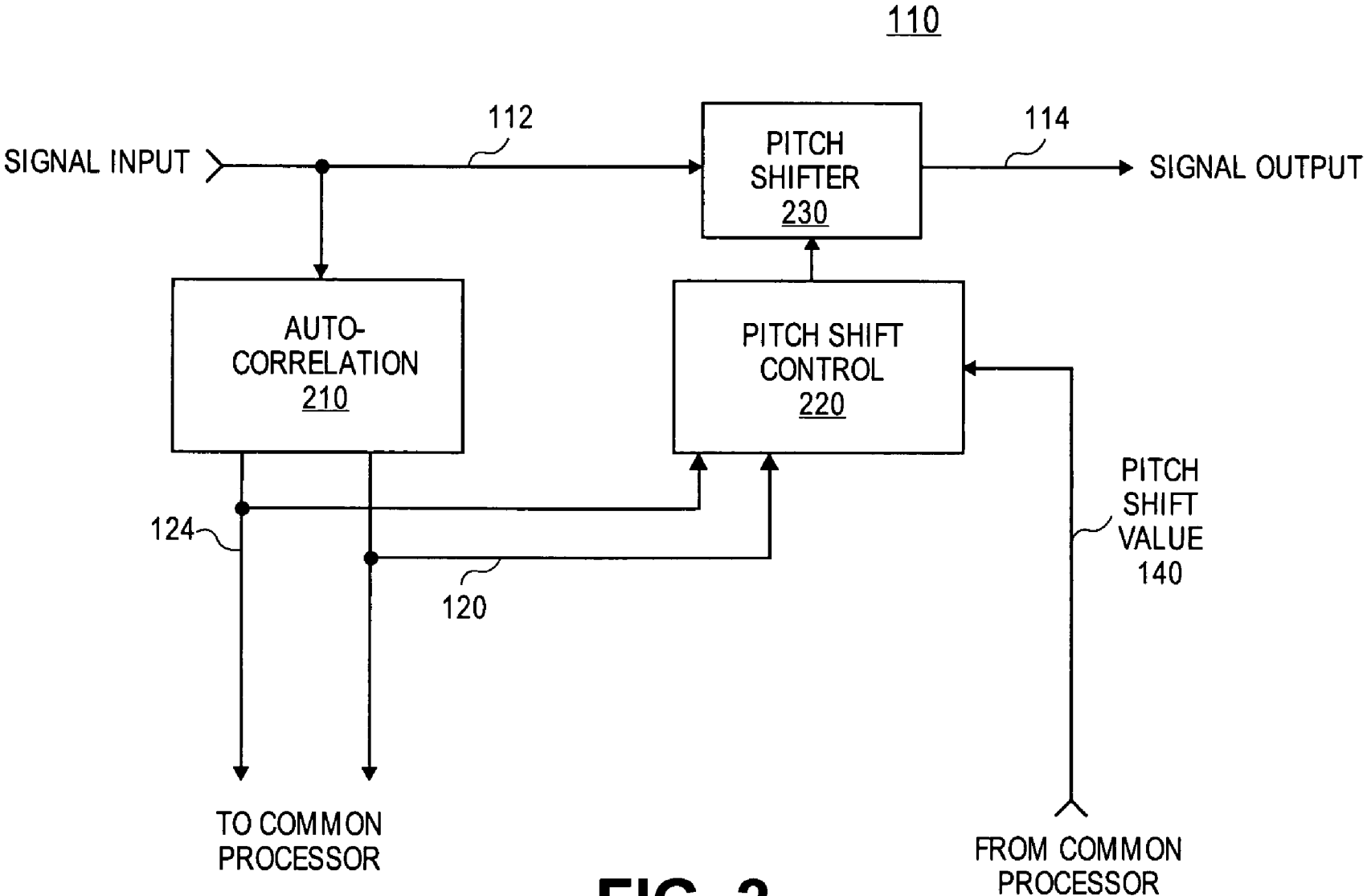
FIG. 2 illustrates one processing channel of the system of FIG. 1, in accordance with an embodiment of the present invention.

FIG. 2 illustrates one processing channel 110 of the system 100 of FIG. 1, in accordance with an embodiment of the present invention. The processing channel 110 comprises auto-correlation logic 210, which is able to determine a fundamental frequency that is present in an audio signal by use of auto-correlation. The input audio signal is input to the auto-correlation logic 210 to determine the fundamental frequency present. The auto-correlation logic 210 outputs the fundamental frequency to the common processor (not depicted in FIG. 2) and to the pitch shift control block 220. The auto-correlation logic 210 also outputs the valid/invalid signal to the common processor and to the pitch shift control block 220.

The pitch shift control block 220 and pitch shifter 230 work together to shift the pitch of the input audio signal. As previously discussed, the input audio signal may have a fundamental frequency and harmonics. In order to preserve the harmonic relationships, the pitch shifter 230 multiplies the frequency of the fundamental frequency by "A", multiplies the frequency of the first harmonic by "2A", etc., in one embodiment. The pitch shift control block 220 and pitch shifter 230 are implemented by pitch synchronous overlap and add (PSOLA), in one embodiment. However, rather than a time domain approach to pitch shifting, such as PSOLA, a frequency domain approach could be used. The pitch shift control block 220 inputs the pitch shift values from the common processor, along with the aforementioned signals from the auto-correlation logic 210. Based on its inputs, the pitch shift control block 220 outputs a signal to the pitch shifter 230, instructing the pitch shifter 130 how to process the input audio signal to achieve the pitch shift. The pitch shifter 230 outputs the pitch shifted audio signal.

Process Flow

Figure 3:
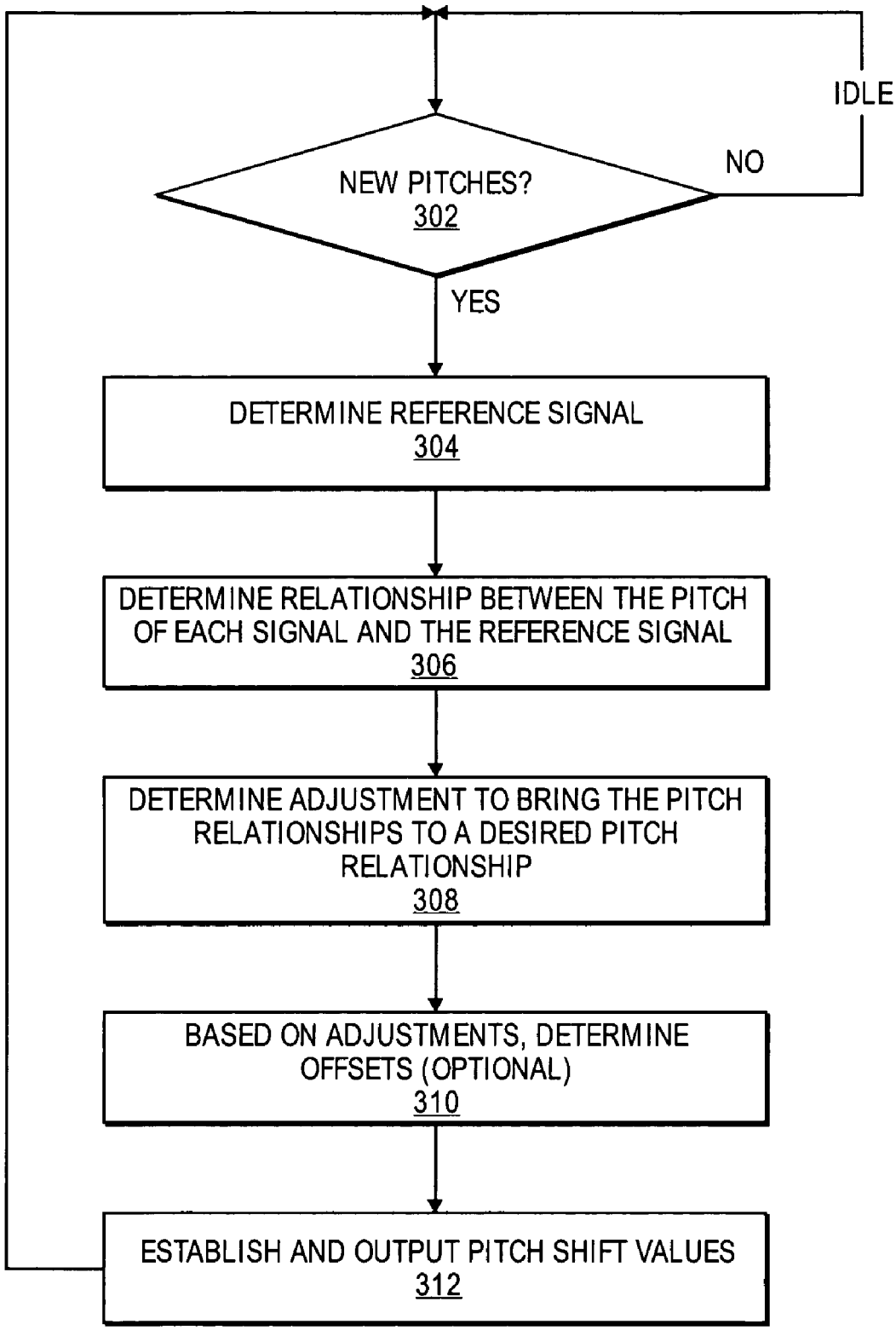
FIG. 3 is a flowchart illustrating steps of a process of shifting the pitch one or more an audio signals to achieve a desired pitch relationship, in accordance with an embodiment of the present invention.

FIG. 3 is a flowchart illustrating steps of a process 300 of determining a pitch shift for audio signals, to create a desired pitch relationship between the audio signals, in accordance with an embodiment of the present invention. Process 300 is an ongoing process that regularly inputs new pitch information describing input audio signals, determines desired pitch shifts based thereon, and outputs pitch shift values. Process 300 will be described with reference to the system 100 of FIG. 1. However, process 300 is not so limited. Steps of process 300 are performed by the common processor 130, in one embodiment. However, process 300 may be performed by hardware or a combination of software and hardware.

Data that describes the pitch of the input audio signals may be input to process 300 from the processing channels, which may perform various signal processing such as determining a fundamental frequency for the respective channel. Process 300 determines and outputs pitch shift values to the processing channels 110.

In step 302, a determination is made as to whether the pitch of an audio signal on any of the channels has changed. For example, the auto-correlation logic for each processing channel 110 repeatedly determines what the fundamental frequency is for its input audio signal. Thus, the auto-correlation logic for each processing channel 110 provides the common processor 130 with updated pitch data and a valid/invalid signal at regular intervals, upon which the determination is based as to whether the pitch any of the audio signals has changed. The following discussion will use an example in which the pitch data indicate that currently three channels have valid pitch data. For example, the audio signal on channel A ("signal A") has a pitch of 200 Hz, the audio signal on channel B ("signal B") has a pitch of 100 Hz, and the audio signal on channel C ("signal C") has a pitch of 140 Hz. Thus, the corresponding processing channels 110*a*-110*c* determine these pitches and pass them to the common processor 130, along with a valid/invalid signals to indicate which of the three channels have valid pitch data.

In step 304, a reference signal is selected from among channels that carry valid signals. The reference signal may be any of the valid input audio signals. The valid audio signal having the lowest pitch is selected as a reference signal, in one embodiment. For the present example, signal B is selected as the reference signal because is has the lowest pitch of the three valid signals. However, the reference signal does not have to be the one with the lowest pitch. For example, the audio signal having the highest pitch might be selected as the reference pitch. In one embodiment, the selection of the reference signal is channel based, rather than pitch based. For example, the audio signal from a particular channel is used as the reference signal. Thus, all of the audio signals may be tuned relative to the audio signal from a particular instrument or voice.

In step 306, a relationship between the pitch of each signal and the reference signal is determined. Using the example signals, the pitch relationships are as follows:

140/100=1.4

200/100=2.0

In step 308, an adjustment is determined to bring the pitch relationships to a desired relationship. This determination is made by the common processor (FIG. 1, 130), in one embodiment. The pitch shift value (determined in step 312) is based, at least in part, on the adjustment. Determining the adjustment is performed for each signal other than the reference signal, in one embodiment. The desired pitch relationship is based on just intonation, in one embodiment. Suitable adjustments can be determined from the following "just intonation ratios": 1/1, 16/15, 9/8, 6/5, 5/4, 4/3, 45/32, 3/2, 8/5, 5/3, 16/9, 15/8, 2/1. The value of just intonation ratios that is closest to the pitch relationship between a particular signal and the reference signal is selected. For example, for the pitch relationship between signal A and signal B, no adjustment is necessary because the pitch relationship of 2/1 is one of the just intonation ratios. For the pitch relationship between signal C and signal B, the closest just intonation ratio is 45/32. If the notes are separated by more than one octave, for example, if pitch of signal B is more than twice the pitch of signal C, then the pitch of signal B can be cut in half until its pitch is in the same octave as signal C.

The initial pitch relationship between signal C and signal B was 7/5. To arrive at a desired pitch relationship of 45/32, based on "just intonation", an adjustment of 1.00446 could be applied to the pitch of signal C. In this example, the adjustment is a correction factor. That is, 1.4*1.00446 is approximately equal to 45/32. If this adjustment were applied to signal C, the new ("provisional") pitch of signal C would be approximately 140.625 Hz. However, as discussed below, an offset may be determined and used to shift the pitch of all of the audio signals. Therefore, the provisional pitch is not necessary the desired pitch for signal C.

The desired pitch relationship does not have to be related to "just intonation". The desired pitch relationship is of the following form, in one embodiment:

n/m, wherein n and m are integers selected from a predetermined set.

For example, both n and m are selected from the set of integers 1 to 16, in one embodiment. Thus, ratios that are not possible using "just intonation" are possible, in this embodiment. Moreover, the desired pitch relationship will not necessarily be the same for all embodiments. For example, in the present embodiment, because the pitch relationship of signal C to signal B is 7/5, no adjustment is needed to bring the pitch relationship to a desired pitch relationship because both integers are between 1 to 16.

In optional step 310, separate offsets based on the adjustments from step 308 are determined. These offsets are used to shift the pitch of each audio signal up or down by the same proportion. A reason for applying this offset is to cause common notes in successive chords to sound better. By applying a pitch shift to all audio signals based on the various offsets, any common notes in successive chords sound better.

To determine the offset, the following is performed, in one embodiment. First, a provisional pitch is determined for each audio signal, based on the adjustments that were determined in step 308. For example, the provisional pitch for signal C is 140.625 Hz, in one example herein. If no adjustment is needed to a particular audio signal, then the provisional pitch is the pitch of the input audio signal.

The provisional pitch of each signal is compared to reference pitches, in one embodiment. The reference pitches are notes of a scale based on equal tempered tuning, in one embodiment. In the just intonation example, signal A (200 Hz) corresponds roughly to G when using equal tempered tuning (196 Hz); signal B (100 Hz) corresponds roughly to G (98 Hz); signal C (140.625 Hz) corresponds roughly to C sharp (138.59 Hz). Next, an error is determined between each signal's provisional pitch and the pitch of the corresponding note if equal tempered tuning were used. The errors are as follows for the present example: signal A error=0.98; signal B error=0.98; signal C error=0.9855. The errors are averaged to arrive at an average error of 0.9818. This average error is used as a pitch offset by multiplying the provisional pitch of each of the audio signals by this amount, in one embodiment.

In step 312, the pitch shift values are established and output. One value is output for each audio signal. The pitch shift value is based at least on the example pitch adjustments determined in step 308. The pitch shift may be expressed as a pitch multiplication. Thus, based on the pitch adjustment determined in step 308 for the just intonation example, the pitch shift values are: signal A=1; signal B=1; signal C=1.00446.

The pitch shift values may be further based on the offset determined in step 310. As an example, based on the example pitch adjustment determined in step 308 and the example offsets determined in step 310, pitch shift values are: signal A=0.9818; signal B=0.9818; signal C=0.98631628.

The pitch shift values, whether based on the adjustments determined in step 308 alone or the adjustments and the offsets determined in step 310, are output to the respective processing channel, which applies them to the respective input audio signals.

Therefore, a pitch shift can be applied to one or more audio signals to achieve a desired pitch relationship between the audio signals. The input audio signals may be taken directly from a live performance or be pre-recorded. The input audio data does not have to be in any special format. The input audio data does not have to conform to any particular way of tuning an instrument. Further, the input audio data is not confined to discrete values. For example, the input audio data may have a continuous range of pitches over at least some usable bandwidth.

Hardware Overview

Figure 4:
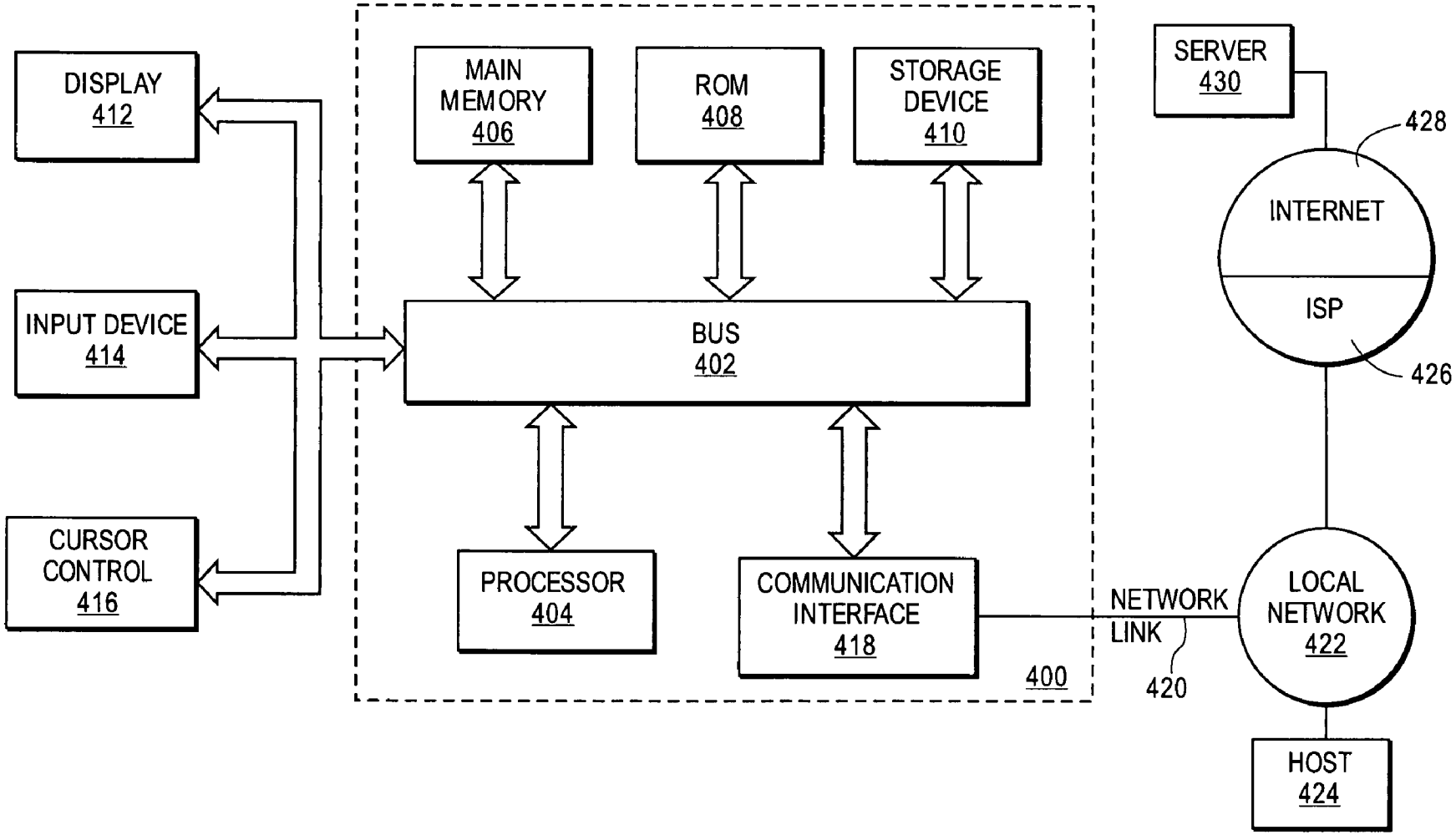
FIG. 4 is a block diagram that illustrates a computer system upon which an embodiment of the invention may be implemented.

FIG. 4 is a block diagram that illustrates a computer system 400 upon which an embodiment of the invention may be implemented. Computer system 400 includes a bus 402 or other communication mechanism for communicating information, and a processor 404 coupled with bus 402 for processing information. Computer system 400 also includes a main memory 406, such as a random access memory (RAM) or other dynamic storage device, coupled to bus 402 for storing information and instructions to be executed by processor 404. Main memory 406 also may be used for storing temporary variables or other intermediate information during execution of instructions to be executed by processor 404. Computer system 400 further includes a read only memory (ROM) 408 or other static storage device coupled to bus 402 for storing static information and instructions for processor 404. A storage device 410, such as a magnetic disk or optical disk, is provided and coupled to bus 402 for storing information and instructions.

Computer system 400 may be coupled via bus 402 to a display 412, such as a cathode ray tube (CRT), for displaying information to a computer user. An input device 414, including alphanumeric and other keys, is coupled to bus 402 for communicating information and command selections to processor 404. Another type of user input device is cursor control 416, such as a mouse, a trackball, or cursor direction keys for communicating direction information and command selections to processor 404 and for controlling cursor movement on display 412. This input device typically has two degrees of freedom in two axes, a first axis (e.g., x) and a second axis (e.g., y), that allows the device to specify positions in a plane.

The invention is related to the use of computer system 400 for implementing the techniques described herein. According to one embodiment of the invention, those techniques are performed by computer system 400 in response to processor 404 executing one or more sequences of one or more instructions contained in main memory 406. Such instructions may be read into main memory 406 from another machine-readable medium, such as storage device 410. Execution of the sequences of instructions contained in main memory 406 causes processor 404 to perform the process steps described herein. In alternative embodiments, hard-wired circuitry may be used in place of or in combination with software instructions to implement the invention. Thus, embodiments of the invention are not limited to any specific combination of hardware circuitry and software.

The term "machine-readable medium" as used herein refers to any medium that participates in providing data that causes a machine to operation in a specific fashion. In an embodiment implemented using computer system 400, various machine-readable media are involved, for example, in providing instructions to processor 404 for execution. Such a medium may take many forms, including but not limited to, non-volatile media, volatile media, and transmission media. Non-volatile media includes, for example, optical or magnetic disks, such as storage device 410. Volatile media includes dynamic memory, such as main memory 406. Transmission media includes coaxial cables, copper wire and fiber optics, including the wires that comprise bus 402. Transmission media can also take the form of acoustic or light waves, such as those generated during radio-wave and infra-red data communications. All such media must be tangible to enable the instructions carried by the media to be detected by a physical mechanism that reads the instructions into a machine.

Common forms of machine-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, and EPROM, a FLASH-EPROM, any other memory chip or cartridge, a carrier wave as described hereinafter, or any other medium from which a computer can read.

Various forms of machine-readable media may be involved in carrying one or more sequences of one or more instructions to processor 404 for execution. For example, the instructions may initially be carried on a magnetic disk of a remote computer. The remote computer can load the instructions into its dynamic memory and send the instructions over a telephone line using a modem. A modem local to computer system 400 can receive the data on the telephone line and use an infra-red transmitter to convert the data to an infra-red signal. An infra-red detector can receive the data carried in the infra-red signal and appropriate circuitry can place the data on bus 402. Bus 402 carries the data to main memory 406, from which processor 404 retrieves and executes the instructions. The instructions received by main memory 406 may optionally be stored on storage device 410 either before or after execution by processor 404.

Computer system 400 also includes a communication interface 418 coupled to bus 402. Communication interface 418 provides a two-way data communication coupling to a network link 420 that is connected to a local network 422. For example, communication interface 418 may be an integrated services digital network (ISDN) card or a modem to provide a data communication connection to a corresponding type of telephone line. As another example, communication interface 418 may be a local area network (LAN) card to provide a data communication connection to a compatible LAN. Wireless links may also be implemented. In any such implementation, communication interface 418 sends and receives electrical, electromagnetic or optical signals that carry digital data streams representing various types of information.

Network link 420 typically provides data communication through one or more networks to other data devices. For example, network link 420 may provide a connection through local network 422 to a host computer 424 or to data equipment operated by an Internet Service Provider (ISP) 426. ISP 426 in turn provides data communication services through the world wide packet data communication network now commonly referred to as the "Internet" 428. Local network 422 and Internet 428 both use electrical, electromagnetic or optical signals that carry digital data streams. The signals through the various networks and the signals on network link 420 and through communication interface 418, which carry the digital data to and from computer system 400, are exemplary forms of carrier waves transporting the information.

Computer system 400 ca send messages and receive data, including program code, through the network(s), network link 420 and communication interface 418. In the Internet example, a server 430 might transmit a requested code for an application program through Internet 428, ISP 426, local network 422 and communication interface 418.

The received code may be executed by processor 404 as it is received, and/or stored in storage device 410, or other non-volatile storage for later execution. In this manner, computer system 400 may obtain application code in the form of a carrier wave.

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method for achieving a desired relationship between pitches of audio signals, said method comprising:

receiving two or more audio signals each having a pitch;

determining a reference signal of the two or more audio signals;

for each audio signal other than the reference signal:

determining a relationship between the pitch of the reference signal and the pitch of the audio signal other than the reference signal;

determining an adjustment to bring the relationship to a desired pitch relationship; and applying a value representing the adjustment to a set of adjustments; and shifting the pitch of at least one of the two or more audio signals, based on the set of adjustments;

wherein the two or more audio signals are derived from a corresponding two or more channels and the reference signal is always taken from the same channel.

2. The method of claim 1, wherein determining an adjustment to bring the relationship to a desired ratio comprises:

accessing a table comprising desired pitch ratios; and selecting from the table a pitch ratio nearest the relationship between the pitch of the reference signal and the pitch of the audio signal other than the reference signal.

3. The method of claim 1, wherein the desired pitch relationship between the pitch of the reference signal and the pitch of the audio signal other than the reference signal is based on a just intonation.

4. The method of claim 1, wherein the desired pitch relationship between the pitch of the reference signal and the pitch of the audio signal other than the reference signal is of the form n/m, wherein each of n and m may have any integer value from 1 to 16.

5. The method of claim 1, further comprising:

determining an offset that is based on the set of adjustments; and shifting the pitch of the two or more audio signals, based on the offset.

6. The method of claim 1, further comprising determining a provisional pitch of each of the two or more audio signals.

7. The method of claim 5, wherein the step of determining an offset further comprises filtering the two or more audio signals to remove undesired pitch variations.

8. The method of claim 1, wherein determining a reference signal of the two or more audio signals is not based on a channel but is instead based on a pitch relationship between the pitches of the two or more audio signals.

9. The method of claim 1, wherein the step of shifting the pitch of at least one of the two or more audio signals comprises shifting the fundamental frequency of a first of the two or more audio signals.

10. The method of claim 9, wherein the step of shifting the pitch of at least one of the two or more audio signals further comprises shifting the frequency of one or more harmonic frequencies of the first audio signals while preserving the harmonic relationships between the fundamental frequency and the one or more harmonic frequencies.

11. A device for providing a tuning for audio signals, said device comprising:

a plurality of processing channels, wherein each said processing channel is operable to:

determine a pitch of an input audio signal; and shift the pitch of the input audio signal based on a pitch shift value to generate an output audio signal;

a processor coupled to the processing channels; and a computer readable medium coupled to the processor and having stored thereon instructions which, when executed by the processor, cause the processor to perform:

receiving the pitch of the input signal from each of the plurality of processing channels;

selecting a reference signal based on the pitch of the input audio signal from each of the plurality of processing channels;

for each audio signal other than the reference signal, performing the following steps:

determining a relationship between the pitch of the audio signal and the pitch of the reference signal; and determining an adjustment, if any, to bring the relationship to a desired pitch relationship;

for each audio signal, including the reference signal, performing the following steps:

based on one or more of the adjustments, establishing a pitch shift value for a particular audio signal; and outputting the pitch shift value to the channel that corresponds to the particular audio signal.

12. The device of claim 11, wherein the instructions which, when executed by the processor, cause the processor to perform determining an adjustment to bring the relationship to a desired ratio comprise instructions which, when executed by the processor, cause the processor to perform:

accessing a table comprising desired pitch ratios; and selecting from the table a pitch ratio nearest the relationship between the pitch of the reference signal and the pitch of the audio signal other than the reference signal.

13. The device of claim 11, wherein the desired pitch relationship between the pitch of the reference signal and the pitch of the audio signal other than the reference signal is based on a just intonation.

14. The device of claim 11, wherein the desired pitch relationship between the pitch of the reference signal and the pitch of the audio signal other than the reference signal is of the form n/m, wherein each of n and m may have any integer value from 1 to 16.

15. The device of claim 11, wherein the instructions which, when executed by the processor, cause the processor to perform determining a reference signal of the two or more audio signals comprise instructions which, when executed by the processor, cause the processor to perform determining a reference signal based on the processing channels associated with the audio signals.

16. The device of claim 11, wherein the instructions which, when executed by the processor, cause the processor to perform determining a reference signal of the two or more audio signals comprise instructions which, when executed by the processor, cause the processor to perform determining a reference signal based on a pitch relationship between the pitches of the two or more audio signals.

17. The device of claim 11, further comprising instructions which, when executed by the processor, cause the processor to perform:

determining an offset that is based on the adjustment for each audio signal other than the reference signal; and shifting the pitch of each of the audio signals, including the reference signal, based on the offset.

18. The device of claim 11, wherein each said processing channel is further operable to determine a provisional pitch of the input audio signal for said processing channel.

19. The device of claim 11, wherein at least one of said processing channels is further operable to filter at least one of the audio signals to remove undesired pitch variations.

20. The device of claim 11, wherein the pitch of the input audio signal is a fundamental frequency of the input audio signal.

21. A method comprising performing a machine-executed operation involving instructions, wherein the machine-executed operation is at least one of:

A) sending said instructions over transmission media;

B) receiving said instructions over transmission media;

C) storing said instructions onto a machine-readable storage medium; and

D) executing the instructions; wherein said instructions are instructions which, when executed by one or more processors, cause the one or more processors to perform the steps of:

for each of a plurality of audio signals, receiving a pitch of the audio signal;

selecting a reference audio signal based on the pitch of each of the audio signals;

for each audio signal other than the reference audio signal, performing the following steps:

determining a relationship between the pitch of the audio signal and the pitch of the reference audio signal;

determining an adjustment, if any, to bring the relationship to a desired pitch relationship;

for each audio signal, including the reference audio signal, performing the following steps:

based on one or more of the adjustments, establishing a pitch shift value for a particular audio signal; and outputting the pitch shift value for the particular audio signal.

22. The method of claim 21, wherein determining an adjustment to bring the relationship to a desired ratio comprises:

accessing a table comprising desired pitch ratios; and selecting from the table a pitch ratio nearest the relationship between the pitch of the reference signal and the pitch of the audio signal other than the reference signal.

23. The method of claim 21, wherein the desired pitch relationship between the pitch of the reference signal and the pitch of the audio signal other than the reference signal is based on a just intonation.

24. The method of claim 21, wherein the desired pitch relationship between the pitch of the reference signal and the pitch of the audio signal other than the reference signal is of the form n/m, wherein each of n and m may have any integer value from 1 to 16.

25. The method of claim 21, wherein the two or more audio signals are derived from a corresponding two or more channels and the reference signal is always taken from the same channel regardless of the relationship between the pitches of the two or more audio signals.

26. The method of claim 21, further comprising:

determining an offset that is based on the adjustment for each audio signal other than the reference signal; and adjusting the pitch of each of the audio signals, including the reference signal, based on the offset.

27. The device of claim 21, wherein the pitch of a particular audio signal is a fundamental frequency of the particular audio signal.

* * * * *